US010224598B2

(12) United States Patent
Wong et al.

(10) Patent No.: US 10,224,598 B2
(45) Date of Patent: Mar. 5, 2019

(54) HIGH-FREQUENCY ROTOR ANTENNA

(71) Applicant: Intel Corporation, Santa Clara, CA (US)

(72) Inventors: Hong W. Wong, Portland, OR (US); Wah Yiu Kwong, Beaverton, OR (US); Jiancheng Johnson Tao, Shanghai (CN); Xiaoguo Liang, Shanghai (CN); Songnan Yang, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/122,851

(22) PCT Filed: Apr. 1, 2014

(86) PCT No.: PCT/CN2014/074525

§ 371 (c)(1),
(2) Date: Aug. 31, 2016

(87) PCT Pub. No.: WO2015/149274

PCT Pub. Date: Oct. 8, 2015

(65) Prior Publication Data

US 2017/0069953 A1 Mar. 9, 2017

(51) Int. Cl.

| | |
|---|---|
| ***H01Q 1/22*** | (2006.01) |
| ***H01Q 1/12*** | (2006.01) |
| ***H01Q 3/06*** | (2006.01) |

(52) U.S. Cl.
CPC ..... *H01Q 1/2266* (2013.01); *H01Q 1/1264* (2013.01); *H01Q 3/06* (2013.01)

(58) Field of Classification Search
CPC ..... H01Q 1/1264
See application file for complete search history.

(56) References Cited

U.S. PATENT DOCUMENTS 3,846,627 A * 11/1974 Chastain ..... B60Q 1/068 362/384
5,644,320 A 7/1997 Rossi
6,281,839 B1 * 8/2001 Nielsen ..... H01Q 1/18 342/372

(Continued)

FOREIGN PATENT DOCUMENTS

CN 1964137 A 5/2007
WO 2015149274 10/2016

OTHER PUBLICATIONS

International Search Report and Written Opinion in International Application No. PCT/CN2014/074525 dated Jan. 5, 2015.

*Primary Examiner* — Graham Smith
(74) *Attorney, Agent, or Firm* — Patent Capital Group

(57) ABSTRACT

In an example, a mobile computing device such as a tablet, laptop, or convertible is operable to couple to a docking station via high-frequency wireless such as WiGig at 60 GHz. Because high-frequency signals are highly directional, the mobile computing device is provided with a high-frequency antenna operable as a rotor. In one embodiment, the antenna is freely hinged to a gravitational pivot, and pivots toward the docking station responsive to gravitational torque. In another embodiment, an actuator drives the antenna to a correct angle responsive to a rotational sensor. In this case, an angle sweep may be performed around a midpoint to identify a best angle for high-frequency communication.

25 Claims, 8 Drawing Sheets

(56) References Cited

U.S. PATENT DOCUMENTS

| | | | | |
|---|---|---|---|---|
| 6,816,121 | B1 | 11/2004 | Cheng et al. | |
| 2011/0050525 | A1* | 3/2011 | Sanada ..... | H01Q 1/3233 343/760 |

* cited by examiner

HIGH-FREQUENCY ROTOR ANTENNA

CROSS-REFERENCE TO RELATED APPLICATION

This Application is a National Stage application under 35 U.S.C. 371 of International Application PCT/CN2014/074525, filed on Apr. 1, 2014 and entitled HIGH-FREQUENCY ROTOR ANTENNA. The disclosure of the prior application is considered part of and is incorporated by reference in the disclosure of this application.

FIELD OF THE DISCLOSURE

This application relates to the field of mobile computing, and more particularly to a high-frequency rotor antenna for a mobile computer.

BACKGROUND

Convertible tablets are a popular form of computing platform that combine advantages of both tablets and laptops. A tablet computer may provide a processor, memory, touch screen, and other functions appropriate to operation as a tablet. The tablet may be operable to couple to a base member, which may provide a full keyboard, trackpad or similar pointing device, additional connectors, and in some cases additional processing resources. The base member may further be operable to couple to a docking station, which may provide an interface to additional resources such as a full monitor and keyboard, external speakers, external storage, and other peripherals.

In some contemporary systems, docking to a tablet, laptop, convertible, or other device to a docking station may comprise docking via a high-bandwidth wireless protocol such as WiGig operating in the 60 GHz frequency range.

BRIEF DESCRIPTION OF THE DRAWINGS

The present disclosure is best understood from the following detailed description when read with the accompanying FIGURES. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION OF THE EMBODIMENTS

Overview

Figure 1:
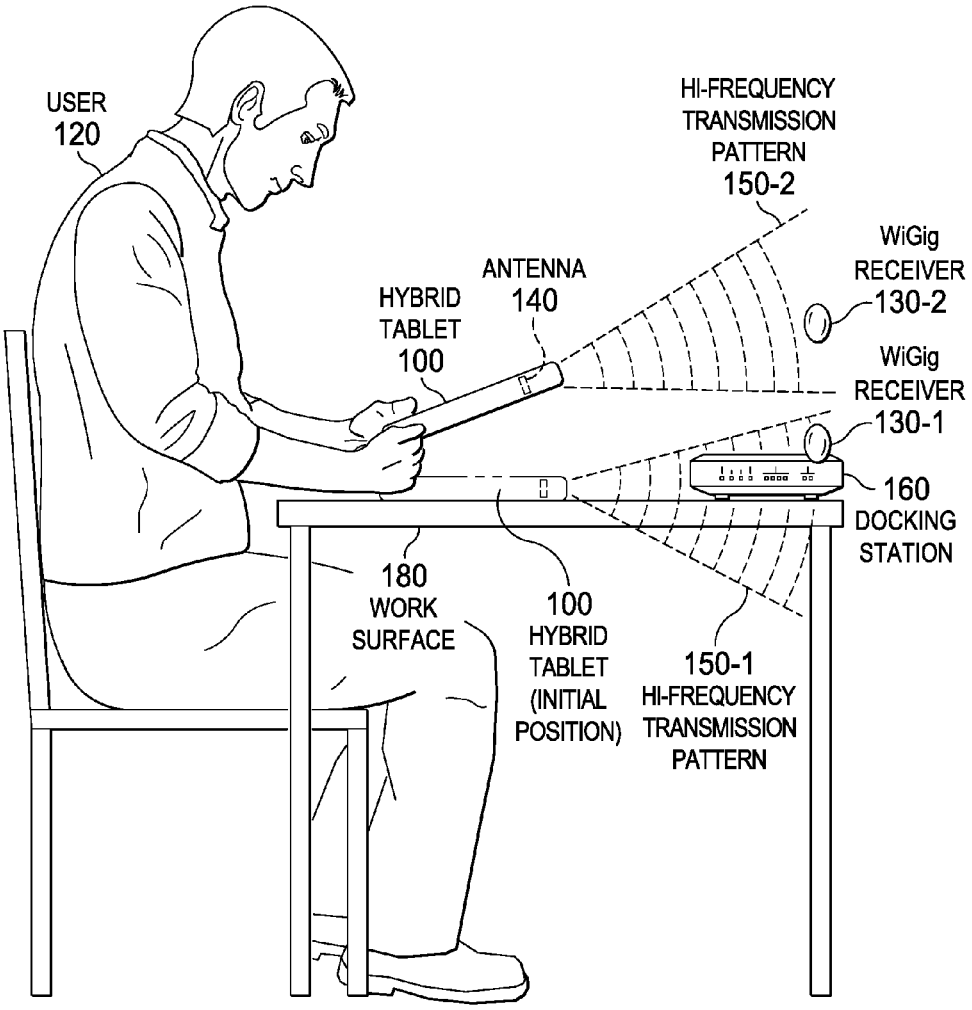
FIG. 1 is a perspective view of a user operating a hybrid tablet according to one or more examples of the present Specification.

In an example, a mobile computing device such as a tablet, laptop, or convertible is operable to couple to a docking station via high-frequency wireless such as WiGig at 60 GHz. Because high-frequency signals are highly directional, the mobile computing device is provided with a high-frequency antenna operable as a rotor. In one embodiment, the antenna is freely hinged to a gravitational pivot, and pivots toward the docking station responsive to gravitational torque. In another embodiment, an actuator drives the antenna to a correct angle responsive to a rotational sensor. In this case, an angle sweep may be performed around a midpoint to identify a best angle for high-frequency communication Example Embodiments of the Disclosure The following disclosure provides many different embodiments, or examples, for implementing different features of the present disclosure. Specific examples of components and arrangements are described below to simplify the present disclosure. These are, of course, merely examples and are not intended to be limiting. Further, the present disclosure may repeat reference numerals and/or letters in the various examples. This repetition is for the purposes of simplicity and clarity and does not in itself dictate a relationship between the various embodiments and/or configurations discussed.

Different embodiments many have different advantages, and no particular advantage is necessarily required of any embodiment.

High-bandwidth local wireless technologies are useful in configuring docking stations that do not necessarily require a physical connection to operate. For example, the modern WiGig protocol provides sufficient bandwidth to enable a laptop computer or tablet to communicatively "dock" to a docking station without physically connecting via wires. This docking may provide useful augmentations to the undocked device, such as improved display, input/output, and networking capabilities. However, operation of high-bandwidth wireless communications devices comes at a cost. The high-frequency radio waves used to carry out such transmission may be carried in a very tight beam, and thus unlike, for example, low-frequency infrared, are most effective when antennas are pointed substantially directly at one another. When one antenna is not pointed substantially at the other, the signal may not experience sufficient dispersion to effectively communicatively couple the two antennas to one another. If coupling does occur, the signals may be substantially attenuated, so that available bandwidth is unacceptably degraded. This may be particularly true in cases where the high-bandwidth wireless communication is provided for docking purposes, in which bandwidth is a primary consideration.

To alleviate the directionality problem described above, certain prior art wireless docking configurations provide two or more WiGig antennae to ensure that a good coupling occurs both when the device is placed on a work surface, and, for example, when the device is picked up by a user. A configuration according to this example is disclosed in FIG. 1. However, placement of two or more antennae may increase the expense of a WiGig configuration, and may consume extra space in certain environments where space is at a premium such as in a cubicle environment. To provide increased directionality of a signal without the need of a second WiGig receiver, FIGS. 3 and 4 disclose additional embodiments in which a rotor antenna is used to help ensure that the antenna remains aligned with an expected location of a WiGig receiver when the device is operated in a raised position. Advantageously, the embodiments of FIGS. 3 and 4 realize increased directionality without the need of additional WiGig receivers, and in some embodiments may be realized entirely by passive parts, thus minimizing complexity and the potential for errors in control and/or logic.

FIG. 1 is a side view of a user operating a computing device, such as a hybrid tablet, including a high-frequency rotor antenna 140 according to one or more examples of the present Specification. In an example, user 120 operates hybrid tablet 100. Hybrid tablet 100 may be any suitable computing device, including a desktop computer, laptop computer, tablet computer, smart phone, or convertible tablet by way of non-limiting example. In an example, user 120 works at a work surface 180 such as a tabletop, desktop, or similar. User 120 may have disposed on work surface 180 a docking station 160. In certain examples, docking station 160 may be a docking station including physical and mechanical interconnects for connecting hybrid tablet 100 to docking station 160, which may interface hybrid tablet 102 additional peripherals such as a monitor, additional storage, additional processing power, speakers, full keyboard, a mouse, and other useful peripherals. In some examples, docking station 160 may provide, in conjunction with, in addition to, or instead of a physical interconnect between hybrid tablet 100 and docking station 160 a high-speed wireless receiver 130, which may be, for example, a WiGig receiver 130-1. WiGig receiver 130-1 may include any suitable high-frequency, or high-bandwidth wireless interface between hybrid tablet 100 and docking station 160. In other examples, WiGig receiver 130-1 may be embodied as some other type of receiver, such as an infrared or Wi-Fi receiver. It should therefore be noted that WiGig receiver 130-1 is disclosed only as one possible embodiment of a suitable receiver and that many types of receiver are possible.

In the particular embodiment where WiGig receiver 130-1 is used, antenna 140 may be configured to provide a high-frequency transmission pattern 150. High-frequency transmission pattern 150 may be highly directional, meaning that displacing hybrid tablet 100 from its initial position on work surface 180 may significantly attenuate the transmission path for high-frequency transmission pattern 150 when hybrid tablet 100 is used in a raised position. This may occur, for example, when user 120 decides to use hybrid tablet 100 in a tablet configuration, wherein user 120 is holding hybrid tablet 100 rather than leaving hybrid tablet 100 while on work surface 180. In certain cases, changing the position of hybrid tablet 100 may cause an unacceptable reduction in or attenuation of high-frequency transmission pattern 150, meaning that adaptation may be necessary to compensate for moving hybrid tablet 100 to a new position. In one example, a second a second WiGig receiver 130-2 may be placed in a second position, so that first WiGig receiver 130-1 is disposed to enable optimal communication with antenna 140 via high-frequency transmission pattern 150-1 when hybrid tablet 100 is lying on work surface 180 in its initial position. Second WiGig receiver 130-2 may be disposed so as to optimize communication with antenna 140 via high-frequency transmission pattern 150-2 when hybrid tablet 100 is in a raised or other position. It should be noted that the two WiGig receivers 130 are disclosed herein by way of example, and that that many other configurations are possible, and that in particular additional WiGig receivers 130 may be added to further supplement reception and additional positions.

Figure 2:
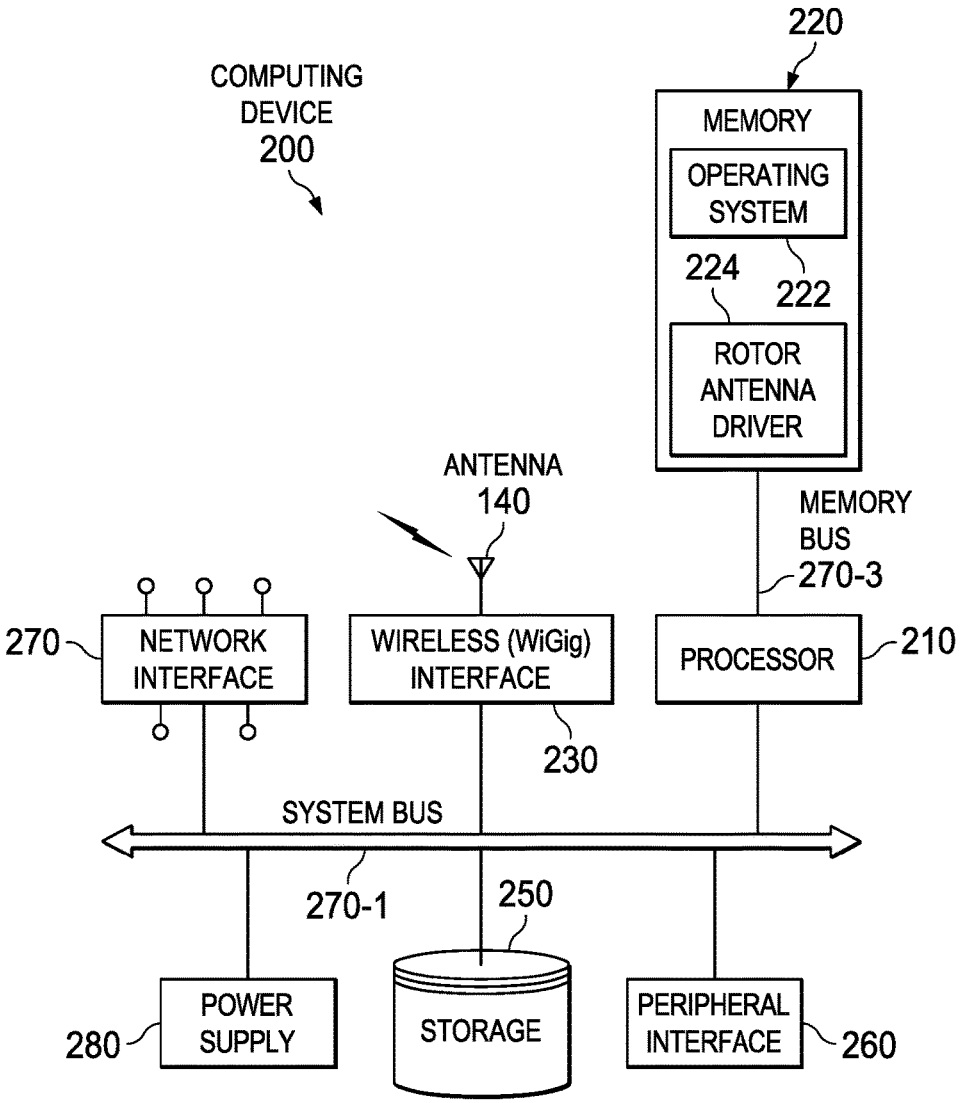
FIG. 2 is a block diagram of a computing device according to one or more examples of the present Specification.

FIG. 2 is a block diagram of computing device 200 according to one or more examples of the present Specification. In various embodiments, a "computing device" may be or comprise, by way of non-limiting example, a computer, embedded computer, embedded controller, embedded sensor, personal digital assistant (PDA), laptop computer, cellular telephone, IP telephone, smart phone, tablet computer, convertible tablet computer, handheld calculator, or any other electronic, microelectronic, or microelectromechanical device for processing and communicating data.

Computing device 200 includes a processor 210 connected to a memory 220, having stored therein executable instructions for providing a rotor antenna driver 224. Other components of computing device 200 include a storage 250, peripheral interface 260, and power supply 280.

In an example, processor 210 is communicatively coupled to memory 220 via memory bus 270-3, which may be, for example, a direct memory access (DMA) bus. Processor 210 may be communicatively coupled to other devices via a system bus 270-1. As used throughout this Specification, a "bus" includes any wired or wireless interconnection line, network, connection, bundle, single bus, multiple buses, crossbar network, single-stage network, multistage network or other conduction medium operable to carry data, signals, or power between parts of a computing device, or between computing devices. It should be noted that these uses are disclosed by way of non-limiting example only, and that some embodiments may omit one or more of the foregoing buses, while others may employ additional or different buses. Power supply 280 may distribute power to system devices via system bus 270-1, or via a separate power bus.

In various examples, a "processor" may include any combination of hardware, software, or firmware providing programmable logic, including by way of non-limiting example a microprocessor, digital signal processor, field-programmable gate array, programmable logic array, application-specific integrated circuit, or virtual machine processor.

Processor 210 may be connected to memory 220 in a DMA configuration via DMA bus 270-3. To simplify this disclosure, memory 220 is disclosed as a single logical block, but in a physical embodiment may include one or more blocks of any suitable volatile or non-volatile memory technology or technologies, including for example DDR RAM, SRAM, DRAM, cache, L1 or L2 memory, on-chip memory, registers, flash, ROM, optical media, virtual memory regions, magnetic or tape memory, or similar. In certain embodiments, memory 220 may comprise a relatively low-latency volatile main memory, while storage 250 may comprise a relatively higher-latency non-volatile memory. However, memory 220 and storage 250 need not be physically separate devices, and in some examples may represent simply a logical separation of function. It should also be noted that although DMA is disclosed by way of non-limiting example, DMA is not the only protocol consistent with this Specification, and that other memory architectures are available. In an example, memory 220 may include an operating system 222 for providing an access layer to system hardware, and a rotor antenna driver 224.

Storage 250 may be any species of memory 220, or may be a separate device, such as a hard drive, solid-state drive, external storage, redundant array of independent disks (RAID), network-attached storage, optical storage, tape drive, backup system, cloud storage, or any combination of the foregoing. Storage 250 may be, or may include therein, a database or databases or data stored in other configurations, and may include a stored copy of operational software such as an operating system and a copy of rotor antenna driver 224. Many other configurations are also possible, and are intended to be encompassed within the broad scope of this Specification.

Figure 8:
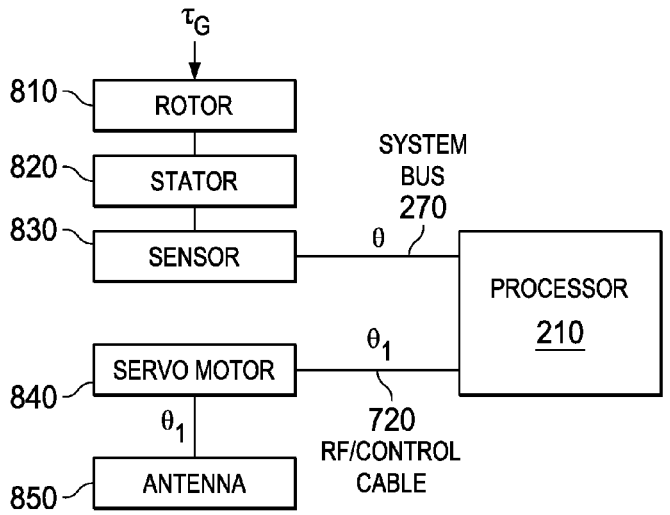
FIG. 8 is a block diagram of a rotor antenna according to one or more examples of the present Specification.

Rotor antenna driver 224, in one example, is a utility or program that carries out a method, such as method 800 of FIG. 8, or other methods according to this Specification. It should also be noted that rotor antenna driver 224 is provided by way of non-limiting example only, and that other software, including interactive or user-mode software, may also be provided in conjunction with, in addition to, or instead of rotor antenna driver 224 to perform methods according to this Specification.

In one example, rotor antenna driver 224 includes executable instructions stored on a non-transitory medium operable to perform method 800 of FIG. 8, or a similar method according to this Specification. At an appropriate time, such as upon booting computing device 200 or upon a command from the operating system or a user, processor 210 may retrieve a copy of rotor antenna driver 224 from storage 250 and load it into memory 220. Processor 210 may then iteratively execute the instructions of rotor antenna driver 224.

Peripheral interface 260 include any auxiliary device that connects to computing device 200 but that is not necessarily a part of the core architecture of computing device 200. A peripheral may be operable to provide extended functionality to computing device 200, and may or may not be wholly dependent on computing device 200. In some cases, a peripheral may be a computing device in its own right. Peripherals may include input and output devices such as displays, terminals, printers, keyboards, mice, modems, network controllers, sensors, transducers, actuators, controllers, data acquisition buses, cameras, microphones, speakers, or external storage by way of non-limiting example.

A network interface 270 may be provided to communicatively couple computing device 200 to, for example, a local computing network. Computing device 200 may also include a wireless interface 230, which may provide hardware, software, and/or firmware services for usefully coupling processor 210 to external devices over a wireless protocol such as WiGig via antenna 140. WiGig interface may be an example of a first wireless transceiver, and may be operable to communicatively couple processor 210 to a second wireless transceiver.

Figure 3:
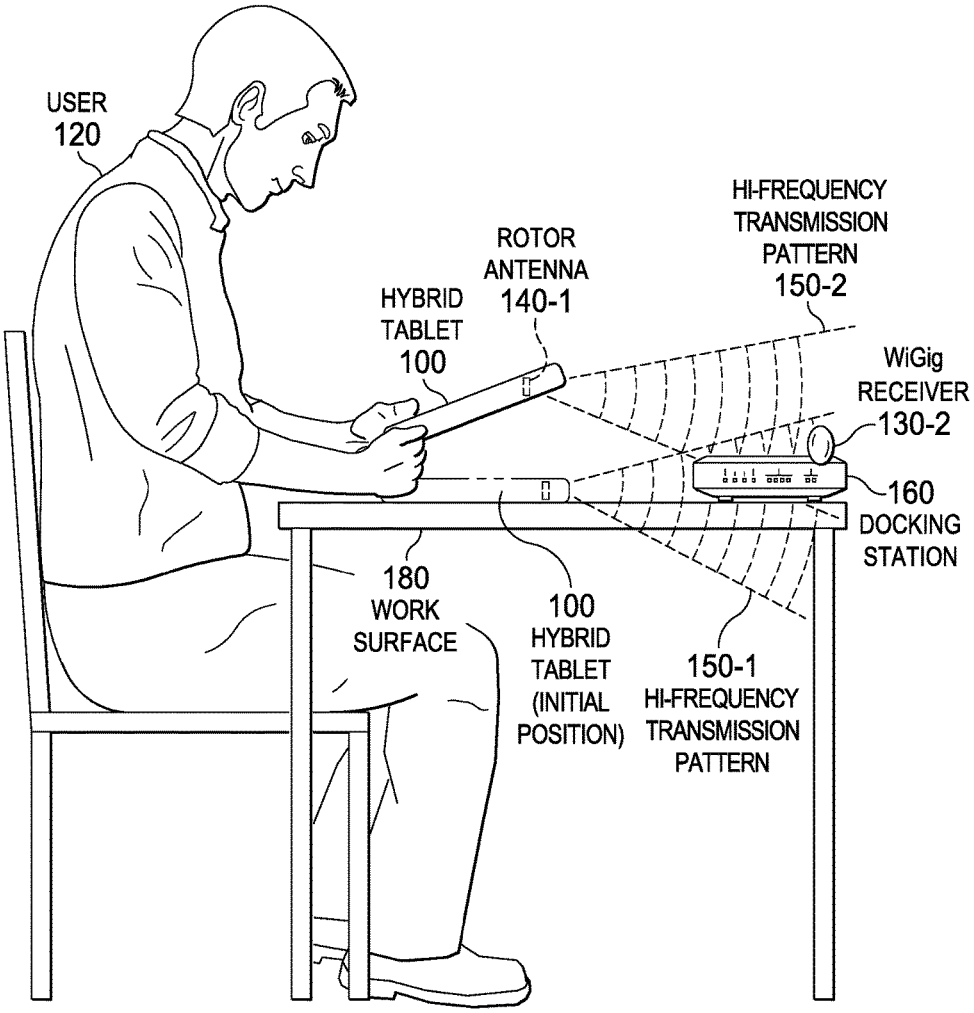
FIG. 3 is a perspective view of a user operating a hybrid tablet according to one or more examples of the present Specification.

FIG. 3 is a side view of user 120 interacting with hybrid tablet 100 according to one or more examples of the present Specification. In the example of FIG. 3, user 120 is using hybrid tablet 100 in conjunction with work surface 180. Initially, hybrid tablet 100 may not lie on work surface 180, that user 120 may lift hybrid tablet 100 to perform user functions. As in FIG. 1, a docking station 160 is provided with a WiGig receiver 130-2. However, and contrary to the embodiment of FIG. 1, and in this example, only one WiGig receiver 130 is provided. Hybrid tablet 100 may be provided with a rotor antenna 140-1. Rotor antenna 140-1 may be a species of antenna 140, but in contrast to the embodiment of FIG. 1, where antenna 140 is fixed within hybrid tablet is in a fixed position within hybrid tablet 100, rotor antenna 140-1 may be configured to be rigidly attached to hybrid tablet 100. Thus, in an example, when hybrid tablet 100 is in its initial position, rotor antenna 140-1 may hang substantially vertically downward. However, when user 120 lifts hybrid tablet 100, rotor antenna 140-1 may be disposed so that its angle relative to hybrid tablet 100 changes with the user's movement.

As can be seen in this embodiment, when hybrid tablet 100 is in its initial position, high-frequency transmission pattern 150-1 is directed substantially directly at docking station 160, and consequently at WiGig receiver 130-2. When user 120 lifts hybrid tablet 100, the angular motion of rotor antenna 140-1 may allow high-frequency transmission pattern 150-2 to remain directed substantially at WiGig receiver 130-2. Advantageously, in certain embodiments, only one WiGig receiver 130 is required in this configuration.

Figure 3A:
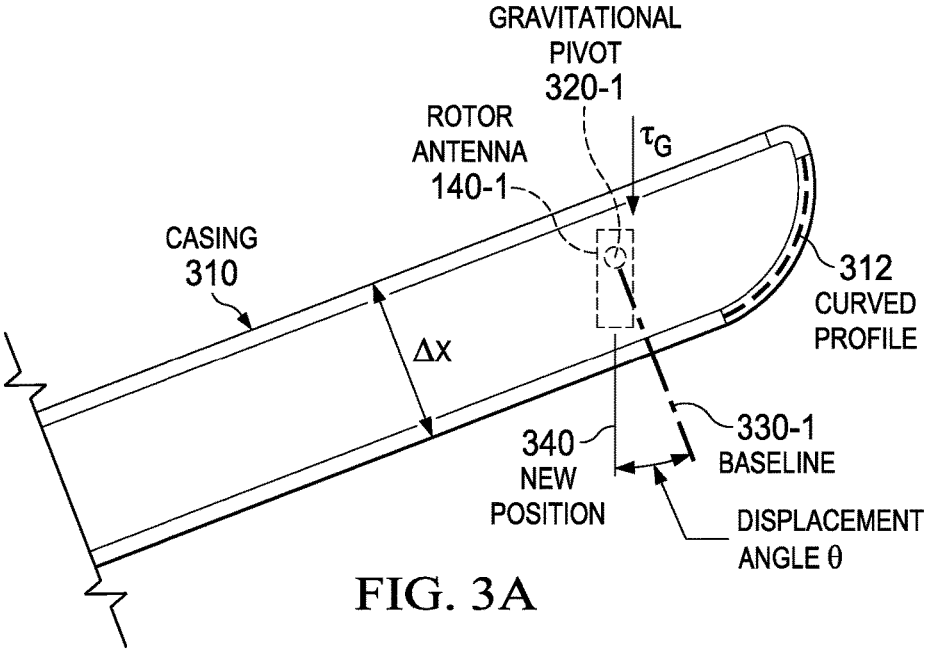
FIG. 3A is a detail cutaway side view of a rotor antenna according to one or more examples of the present Specification.

FIG. 3A is a cutaway detail view of a hybrid tablet 100 according to one or more examples of the present Specification. In this example, router antenna 140-1 may include a gravitational pivot 320-1. Gravitational pivot 320-1 may be provided to allow rotor antenna 140-1 to rotate freely responsive to a gravitational torque $\tau_G$. In one example, when hybrid tablet 100 is in its initial position, for example lying flat on work surface 180, router antenna 140-1 naturally moves to a position substantially vertical, or in other words substantially perpendicular with respect to work surface 180. When user 120 lifts hybrid tablet 100, gravitational torque $\tau_G$ acts on rotor antenna 140-1.

When gravitational torque $\tau_G$ acts on rotor antenna 140-1, gravitational torque $\tau_G$ causes rotor antenna 140-1 to rotate on gravitational pivot 320-1, and to move from baseline 330-1 displacement angle $\theta$ to new position 340. In this example, gravitational pivot 320-1 is placed substantially in the center of a first axis running the width of rotor antenna 140-1, and near a terminal end of a second axis running the length of rotor antenna 140-1. This enables rotor antenna 140-1 to remain substantially orthogonal to the plane of work surface 180. This rotation of rotor antenna 140-1 may enable a directional change of high-frequency transmission pattern 150-2 from the direction visible in FIG. 1 to the direction visible in FIG. 3. Thus, high-frequency transmission pattern 150 will experience less attenuation in FIG. 3 than in FIG. 1. This may obviate the need for additional WiGig receivers 130-2 for docking station 160.

In one or more embodiments, an external casing 310 may be provided around hybrid tablet 100. Casing 310 may provide a useful form factor as well as physical protection.

In one or more embodiments, hybrid tablet 100 may be provided with a casing 310, which may provide a physical form factor and mechanical protection for hybrid tablet 100. In certain embodiments of the present Specification, casing 310 may be provided with a curved profile 312 as seen in FIG. 3A. In certain embodiments, curved profile 312 may be superior to a straight or rectangular profile which in certain cases has inferior RF transmission properties to curved profile 312. Thus, by providing curved profile 312, attenuation of high-frequency transmission pattern 150-2 is further reduced.

Figure 4A:
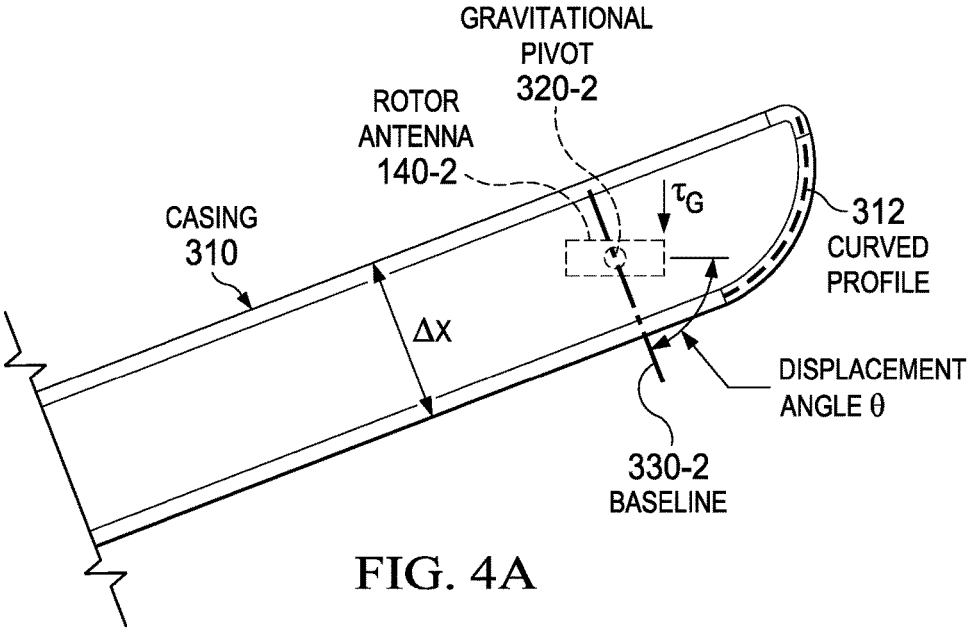
FIG. 4A is a detail cutaway side view of a rotor antenna according to one or more examples of the present Specification.
Figure 4:
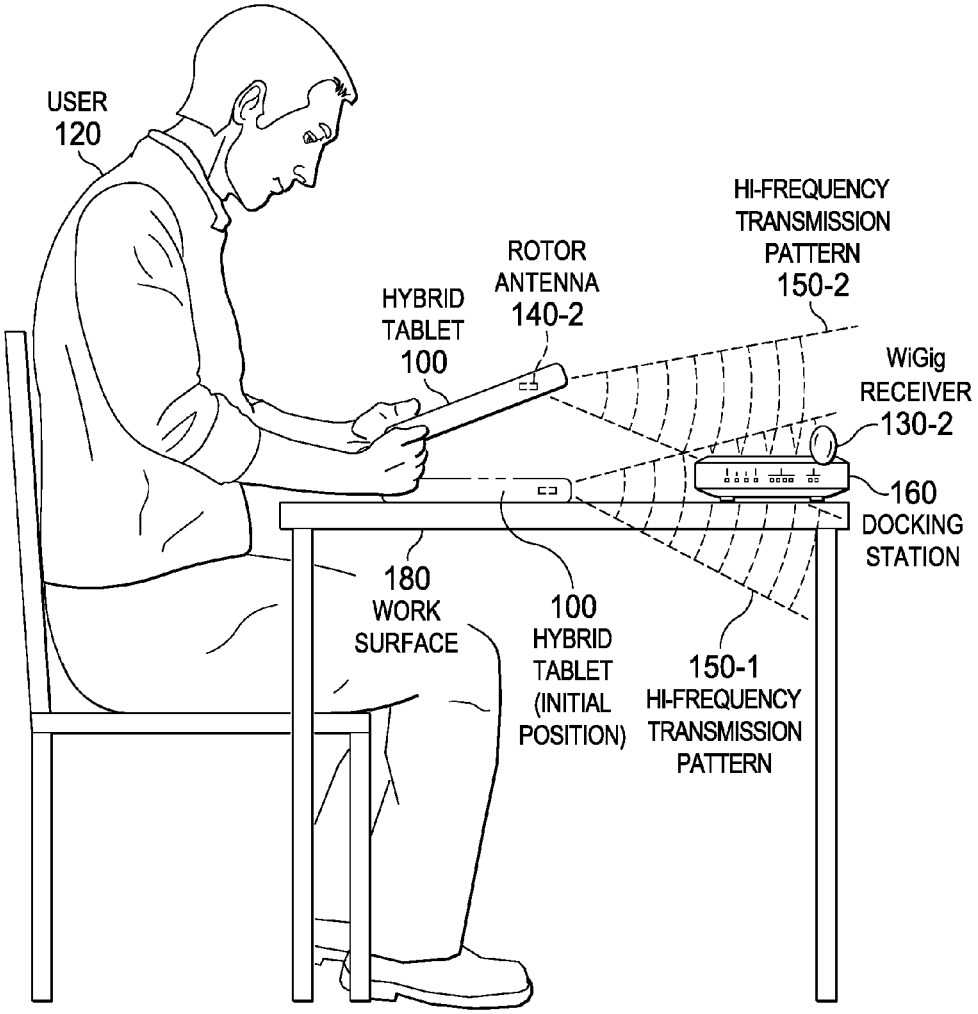
FIG. 4 is a perspective view of a user operating a hybrid tablet according to one or more examples of the present Specification.

FIG. 4 is a side view of user 120 operating hybrid tablet 100 according to one or more examples of the present Specification. In the example of FIG. 4, yet another species of rotor antenna 140-2 is provided. In the embodiment of FIG. 4, one rotor antenna 140-2 may include a gravitational pivot similar to gravitational pivot 320-1 of FIG. 3A. However in the embodiment of FIG. 4, gravitational pivot 320-2 may be disposed so as to allow rotor antenna 140-2 to rotate around a centroid rather than around a terminal end of rotor antenna 140. This is best seen in connection with FIG. 4A, which is a detailed view of a hybrid tablet 100 of FIG. 4. As seen in FIG. 4, and gravitational pivot 320-2 of rotor antenna 140-2 is disposed near a centroid of rotor antenna 140-2. Unlike the placement of rotor antenna 140-1, rotor antenna 140-2 is placed in a center along two axes. Rather than allowing rotor antenna 140-2 to hang "straight down" as in the case of rotor antenna 140-1, rotor antenna 140-2 is operable to remain substantially parallel to work surface 180. Thus, baseline 330-2 of FIG. 4A is substantially parallel to work surface 180 instead of perpendicular to work surface 180. Furthermore, whereas the embodiment of FIG. 3A is operable to maintain rotor antenna 140-1 substantially perpendicular to work surface 180, the embodiment of FIG. 4A is operable to maintain rotor antenna 140-2 substantially parallel work surface 180.

As with FIG. 3A, the embodiment of FIG. 4A may include a curved profile 312 to reduce attenuation of high-frequency transmission pattern 150-2.

The embodiments of FIGS. 3, 3A, 4, and 4A, disclose only two of many possible arrangements of rotor antenna 140. Those with skill in the art will recognize that many possible types of rotor antenna 140 may be used, and that a gravitational pivot 320 may be placed so as to enable rotor antenna 140 to rotate in a desired manner. In yet other embodiments, casing 310 may have a thickness $\Delta X$. The thickness $\Delta X$ of casing 310 in some embodiments may not be sufficient to enable a rotor antenna 140 to rotate completely to a desired position. For example, in the embodiments disclosed in FIGS. 3A and 4A, rotor antenna 140 is disclosed as having a length substantially shorter than $\Delta X$. However, in some ultralight or ultraportable embodiments, certain design considerations may restrain $\Delta X$ to very small values. Thus a rotor antenna 140 may not be able to rotate with two complete degrees of freedom and to reach a desired displacement angle $\theta$. In that case, it may still be desirable to provide a gravitational pivot 320 so that rotor antenna 140 can rotate to the extent possible. It has been found that in certain embodiments, even a $\theta$ of 10° difference from the fixed position of FIG. 1 may provide substantial signal boost with respect to the highly attenuated high-frequency transmission pattern 150-2 of FIG. 1. Thus, in cases where rotor antenna 140 has a length equal to or longer than $\Delta X$, rotor antenna 140 cannot rotate freely to an optimal position. It is still desirable to use a rotor antenna 140 so that rotor antenna 140 can rotate to an intermediate position $\theta_1$ to provide a desirable angle. It will be noted that in the embodiments of FIG. 3A and in FIG. 4A, rotor antenna 140-1 and rotor antenna 140-2 may be considered to passively rotate responsive to a gravitational torque $\tau_G$. It should be recognized however that it is not intended that this Specification be limited to passive rotation. In certain embodiments, including, for example, the embodiment of FIGS. 7 and 8, active rotation of rotor antenna 140 may also be provided.

Figure 5:
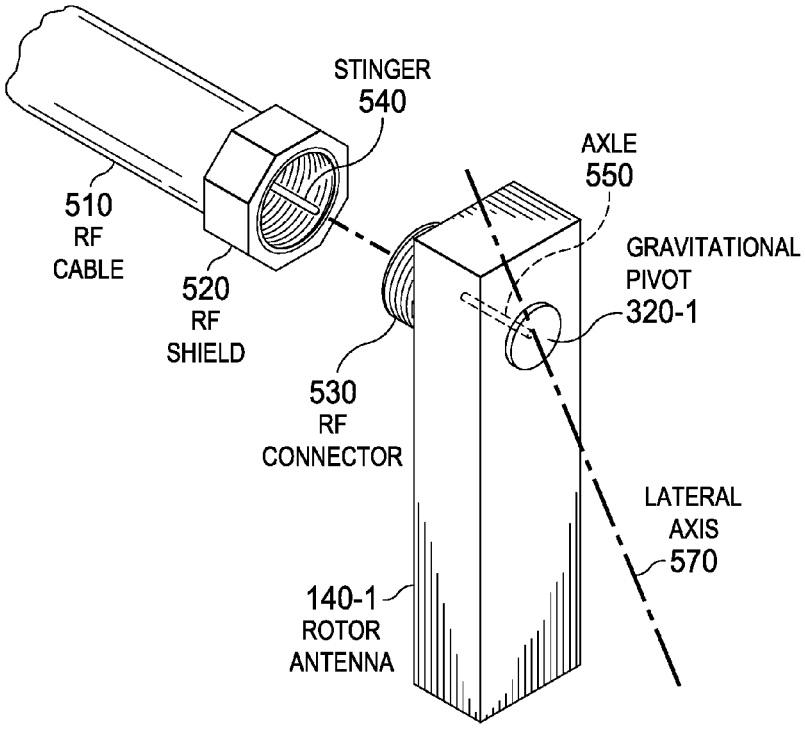
FIG. 5 is a perspective view of a rotor antenna according to one or more examples of the present Specification.

FIG. 5 is an exploded perspective view of rotor antenna 140-1 according to one or more examples of the present Specification. As can be seen in FIG. 5, gravitational pivot 320-1 is provided near a distal end of rotor antenna 140-1. Specifically, a lateral axis 570 may be defined along the length of rotor antenna 140-1, and a longitudinal axis 580 along a width of rotor antenna 140-1. Gravitational pivot 320-1 may be placed substantially at a center line of longitudinal axis 580, and near a terminal end of rotor antenna 140-1 on lateral axis 570. This allows rotor antenna 140-1 to rotate toward a position that remains substantially orthogonal to work surface 180 (FIG. 1).

In certain embodiments, an RF connector 530 may be provided mechanically coupled to and in a similar position to gravitational pivot 320-1. This avoids, for example, a situation where an RF cable 510 provides an additional torque on gravitational pivot 320-1. In this case, an axle 550 is provided through gravitational pivot 320-1, and may include a receiving member for Stinger 540. In thus, rotor antenna 140-1 may be operable to rotate around the axis of RF cable 510 when Stinger 540 is plugged into axle 550, and RF shield 520 is connected to RF connector 530. This may allow optimal freedom of motion for rotor antenna 140-1.

Figure 6:
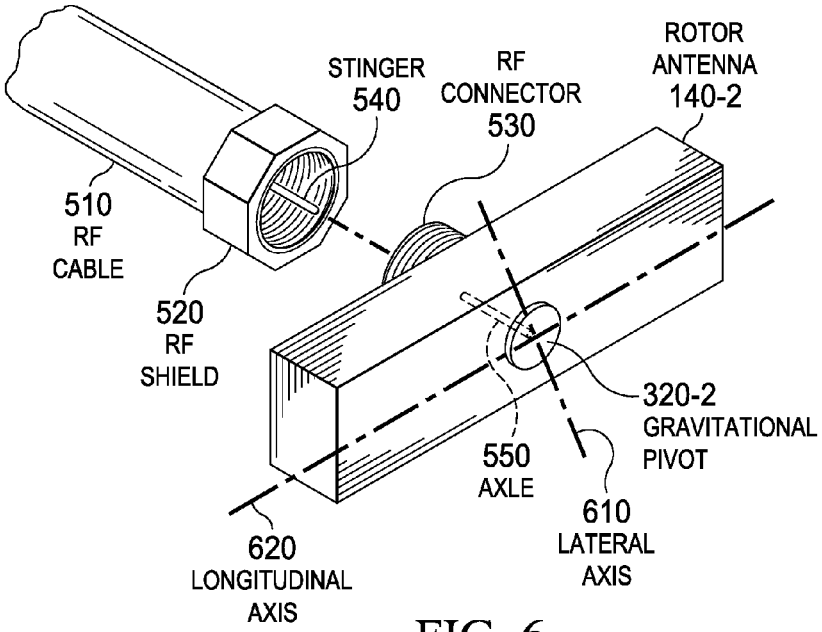
FIG. 6 is a perspective view of a rotor antenna according to one or more examples of the present Specification.

FIG. 6 is a cutaway, an exploded perspective view, of rotor antenna 140-2. Rotor antenna 140-2 may be substantially similar to rotor antenna 140-1, but in this case, gravitational pivot 320-2 may be substantially centered along both lateral axis 610 and longitudinal axis 620. Thus, in rotor antenna 140-2 may be enabled to remain substantially parallel to work surface 180.

Figure 7:
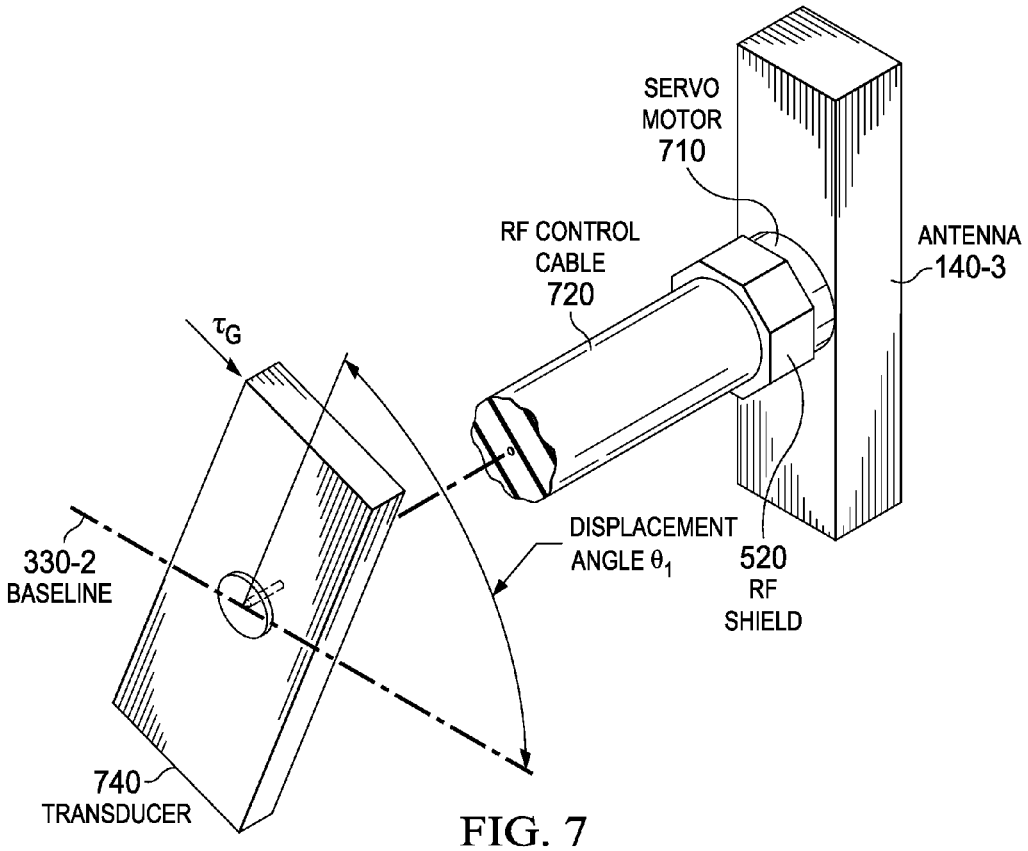
FIG. 7 is a perspective view of a rotor antenna according to one or more examples of the present Specification.

FIG. 7 and FIG. 8 discloses an embodiment of rotor antenna 140-3 wherein a displacement angle $\theta$ of rotor antenna 140-3 is actively maintained. According to the embodiment of FIG. 7, antenna 140-3 is mechanically coupled to a servomotor 710. Servomotor 710 may be mechanically and electrically coupled to RF shield 520 and RF control cable 720. RF control cable 720 may be a species of cable that provides both an RF signal and control signals to servo motor 710. RF control cable 720 may also be further configured to provide power to servo motor 710. In this embodiment, a separate transducer 740 may be provided to detect an angle of rotation $\theta_1$. In one or more embodiments, transducer 740 may be, for example, an angular switch, a synchro, a resolver, a synchro-resolver, or any other similar type of angle sensitive sensor.

FIG. 8 is a block diagram that discloses mechanical and electrical couplings of the system shown in FIG. 7 according to one or more examples of the present Specification. In particular, in block 810, a gravitational torque $\tau_G$ is exerted on rotor antenna 140. In block 820, a stator may be provided and may be operable to detect a displacement of transducer 740. In block 820, a transducer 740 may detect the rotation of rotor 810. In block 830, a sensor element may translate the input of displacement $\theta_1$ to an electrical signal, and may provide displacement angle $\theta$ as a signal to processor 210 over system bus 270. Processor 210 may then provide angle $\theta_1$ to rotor antenna 140-3. The angle $\theta_1$ may be determined, for example, based on an optimal rotation and on the thickness $\Delta X$ of casing 310. Processor 210 may provide $\theta_1$ over RF control cable 720 to servomotor 710 in block 840. In block 850, servomotor 710 may rotate rotor antenna 140-3 by an angle of $\theta_1$.

Figure 9:
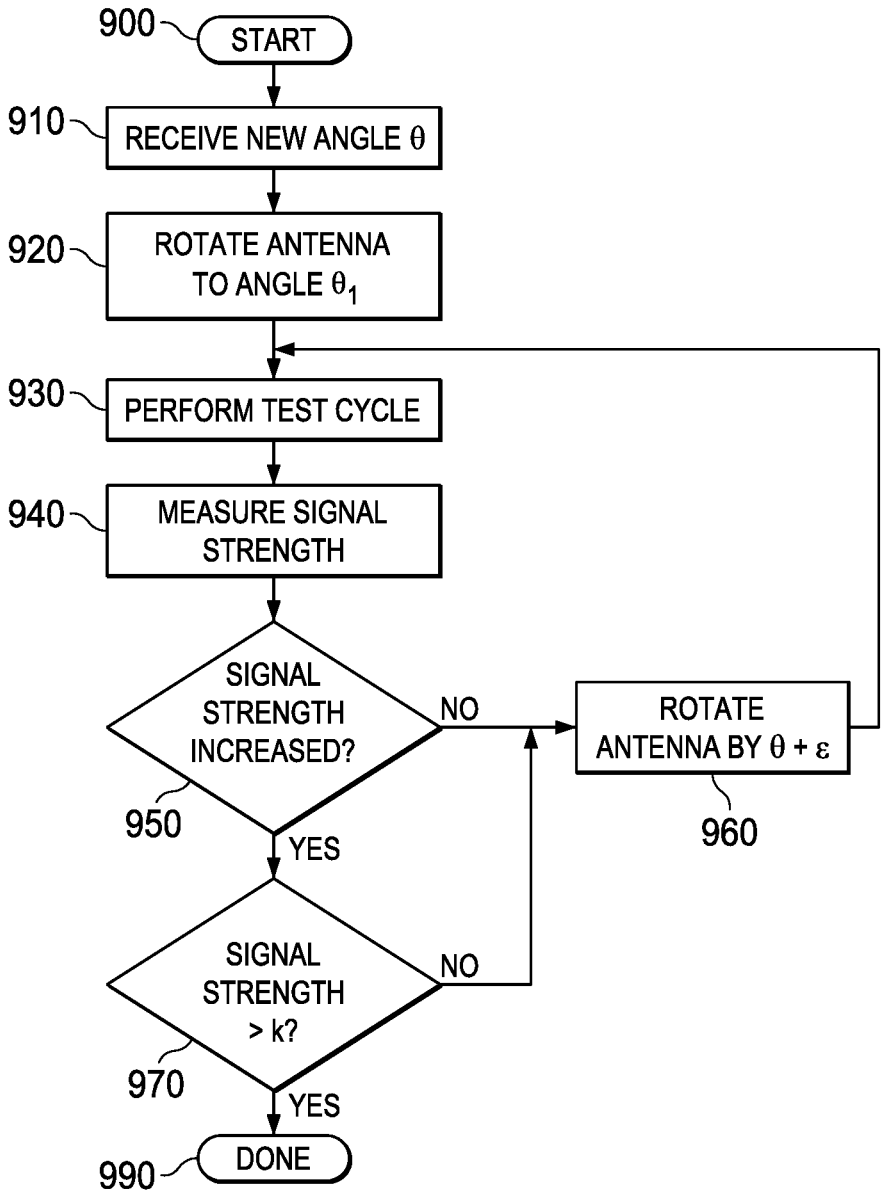
FIG. 9 is a flow chart of a method according to one or more examples of the present Specification.

FIG. 9 is a flow chart of a method 900 that may be performed by computing device 100, to identify an optimal angle to rotate a rotor antenna 140 according to one or more examples of the present Specification. The method FIG. 9 is an active method, and is provided by way of example only, and it should be noted that many other active and passive methods are possible according to specification. In block 910, processor 210 may receive a signal representing an angular displacement $\theta$ over system bus 270-1 from transducer 740.

In block 920, processor 210 may calculate an angle $\theta_1$ to rotate antenna 143. Angle $\theta_1$ may be based, for example, on $\Delta X$ of casing 310, or on other factors. Thus, while in most embodiments angle $\theta_1$ may be rationally related to angle $\theta$, they need not be identical.

In block 930, processor 210 may operate wireless interface 230 to drive a test signal on antenna 140 and perform a test cycle, such as a handshake.

In block 940, processor 210 may measure a signal strength high-frequency transmission pattern 150 based on the handshake procedure performed in block 930. In block 950, processor 210 may test to see whether the signal strength of high-frequency transmission pattern 150 is increased with respect to a reference amount.

In block 960, if the signal strength is not increased, then processor 210 may rotate antenna 140 by a new angle, characterized by $\theta+\varepsilon$, wherein $\varepsilon$ is a small additional displacement angle. It should be noted that $\theta+\varepsilon$ may indicate rotation in either direction, and those having skill in this art will be able to choose appropriate values for $\theta$ and $\varepsilon$ and appropriate signs to properly zero in on an optimal angle. Returning to block 950 after block 960, control passes back to block 930, wherein another test cycle is performed.

Returning to block 950, if the signal strength has increased, then in block 970, processor 210 may check to see whether the strength of high-frequency transmission pattern 150 has exceeded a threshold value K. When high-frequency transmission pattern 150 exceeds a signal strength of K, the process may be deemed complete, inasmuch as sufficient operational signal strength has been achieved. Thus, if this is true, then in block 990, the process is done. Returning to block 970, if signal strength of high-frequency transmission pattern 150 does not exceed the threshold value, then control may pass to block 960, or a small adjustment to angle $\theta$ may be made. It should be noted that additional steps may be provided, for example to prevent method 900 from entering infinite loop when signal strength K cannot be achieved, and for other similar circumstances. Thus, it should be recognized, that method 900 provides a useful example of a procedure, but other details may be added in certain embodiments.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The particular embodiments of the present disclosure may readily include a system on chip (SOC) central processing unit (CPU) package. An SOC represents an integrated circuit (IC) that integrates components of a computer or other electronic system into a single chip. It may contain digital, analog, mixed-signal, and radio frequency functions: all of which may be provided on a single chip substrate. Other embodiments may include a multi-chip-module (MCM), with a plurality of chips located within a single electronic package and configured to interact closely with each other through the electronic package. In various other embodiments, the digital signal processing functionalities may be implemented in one or more silicon cores in Application Specific Integrated Circuits (ASICs), Field Programmable Gate Arrays (FPGAs), and other semiconductor chips.

In example implementations, at least some portions of the processing activities outlined herein may also be implemented in software. In some embodiments, one or more of these features may be implemented in hardware provided external to the elements of the disclosed FIGURES, or consolidated in any appropriate manner to achieve the intended functionality. The various components may include software (or reciprocating software) that can coordinate in order to achieve the operations as outlined herein. In still other embodiments, these elements may include any suitable algorithms, hardware, software, components, modules, interfaces, or objects that facilitate the operations thereof.

Additionally, some of the components associated with described microprocessors may be removed, or otherwise consolidated. In a general sense, the arrangements depicted in the FIGURES may be more logical in their representations, whereas a physical architecture may include various permutations, combinations, and/or hybrids of these elements. It is imperative to note that countless possible design configurations can be used to achieve the operational objectives outlined herein. Accordingly, the associated infrastructure has a myriad of substitute arrangements, design choices, device possibilities, hardware configurations, software implementations, equipment options, etc.

Any suitably-configured processor component can execute any type of instructions associated with the data to achieve the operations detailed herein. Any processor disclosed herein could transform an element or an article (for example, data) from one state or thing to another state or thing. In another example, some activities outlined herein may be implemented with fixed logic or programmable logic (for example, software and/or computer instructions executed by a processor) and the elements identified herein could be some type of a programmable processor, programmable gate array (FPGA), an erasable programmable read only memory (EPROM), an electrically erasable programmable read only memory (EEPROM)), an application-specific integrated circuit (ASIC) that includes digital logic, software, code, electronic instructions, flash memory, optical disks, CD-ROMs, DVD ROMs, magnetic or optical cards, other types of machine-readable mediums suitable for storing electronic instructions, or any suitable combination thereof. In operation, processors may store information in any suitable type of non-transitory storage medium (for example, random access memory (RAM), read only memory (ROM), FPGA, EPROM, EEPROM, etc.), software, hardware, or in any other suitable component, device, element, or object where appropriate and based on particular needs. Further, the information being tracked, sent, received, or stored in a processor could be provided in any database, register, table, cache, queue, control list, or storage structure, based on particular needs and implementations, all of which could be referenced in any suitable timeframe. Any of the memory items discussed herein should be construed as being encompassed within the broad term 'memory.' Similarly, any of the potential processing elements, modules, and machines described herein should be construed as being encompassed within the broad term 'microprocessor' or 'processor.' Furthermore, in various embodiments, the processors, memories, network cards, buses, storage devices, related peripherals, and other hardware elements described herein may be realized by a processor, memory, and other related devices configured by software or firmware to emulate or virtualize the functions of those hardware elements.

Computer program logic implementing all or part of the functionality described herein is embodied in various forms, including, but in no way limited to, a source code form, a computer executable form, and various intermediate forms (for example, forms generated by an assembler, compiler, linker, or locator). In an example, source code includes a series of computer program instructions implemented in various programming languages, such as an object code, an assembly language, or a high-level language such as OpenCL, Fortran, C, C++, JAVA, or HTML for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

In the discussions of the embodiments above, the buffers, graphics elements, interconnect boards, clocks, sensors, amplifiers, switches, digital core, transistors, and/or other components can readily be replaced, substituted, or otherwise modified in order to accommodate particular circuitry needs. Moreover, it should be noted that the use of complementary electronic devices, hardware, non-transitory software, etc. offer an equally viable option for implementing the teachings of the present disclosure.

In one example embodiment, any number of electrical circuits of the FIGURES may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself. In another example, the electrical circuits of the FIGURES may be implemented as stand-alone modules (e.g., a device with associated components and circuitry configured to perform a specific application or function) or implemented as plug-in modules into application specific hardware of electronic devices.

Note that with the numerous examples provided herein, interaction may be described in terms of two, three, four, or more electrical components. However, this has been done for purposes of clarity and example only. It should be appreciated that the system can be consolidated in any suitable manner. Along similar design alternatives, any of the illustrated components, modules, and elements of the FIGURES may be combined in various possible configurations, all of which are clearly within the broad scope of this Specification. In certain cases, it may be easier to describe one or more of the functionalities of a given set of flows by only referencing a limited number of electrical elements. It should be appreciated that the electrical circuits of the FIGURES and its teachings are readily scalable and can accommodate a large number of components, as well as more complicated/sophisticated arrangements and configurations. Accordingly, the examples provided should not limit the scope or inhibit the broad teachings of the electrical circuits as potentially applied to a myriad of other architectures.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "steps for" are specifically used in the particular claims; and (b) does not intend, by any statement in the Specification, to limit this disclosure in any way that is not otherwise reflected in the appended claims.

Example Embodiment Implementations

There is disclosed in example 1, an apparatus comprising:

an antenna operable for high-frequency directional wireless communication; and a pivot for rotatably mechanically coupling the antenna to a mobile computing device;

wherein the rotor antenna is operable to adjust to an angle $\theta_1$ responsive to moving the rotor antenna through an angle $\theta_0$.

There is disclosed in example 2, the apparatus of example 1, wherein $\theta_1$ is substantially equal to $\theta_0$.

There is disclosed in example 3, the apparatus of example 1, wherein $\theta_1$ is substantially equal to $\theta_0$ up to a limiting angle $\theta_2$.

There is disclosed in example 4, the apparatus of example 1, further comprising an angular transducer, and wherein the rotor antenna is mechanically coupled to an actuator operable to receive an angular displacement signal $\theta_t$ and responsive to $\theta_t$, to rotate the rotor antenna to $\theta_1$.

There is disclosed in example 5, the apparatus of example 1, wherein the rotor antenna is configured to receive a radio frequency (RF) cable at the pivot.

There is disclosed in example 6, the apparatus of example 1, wherein the pivot is a gravitational pivot.

There is disclosed in example 7, the apparatus of example 6, wherein the rotor antenna has a longitudinal axis and a lateral axis, and wherein the gravitational pivot is disposed substantially on a centerline of both dimensions.

There is disclosed in example 8, the apparatus of example 6, wherein the rotor antenna has a longitudinal axis and a lateral axis, and wherein the gravitational pivot is disposed substantially near an end point of a centerline through the lateral axis.

There is disclosed in example 9, the apparatus of example 6, wherein the gravitational pivot comprises a radio frequency (RF) connector.

There is disclosed in example 10, the apparatus of example 9, wherein the RF connector is rotatably mechanically coupled to an RF cable.

There is disclosed in example 11, the apparatus of example 1, further comprising a casing, wherein the casing comprises a curved profile section disposed to reduce wireless signal interference between the first wireless transceiver and the second wireless transceiver.

There is disclosed in example 12, a system comprising:

a first wireless transceiver; and a rotor antenna operable to communicatively couple the first wireless transceiver to a second wireless transceiver;

wherein the rotor antenna is operable to adjust to an angle $\theta_1$ responsive to a placement of the system at an angle $\theta_0$.

There is disclosed in example 13, the system of example 12, wherein $\theta_1$ is substantially equal to $\theta_0$.

There is disclosed in example 14, the system of example 12, wherein $\theta_1$ is substantially equal to $\theta_0$ up to a limiting angle $\theta_2$.

There is disclosed in example 15, the system of example 12, further comprising an angular transducer, and wherein the rotor antenna is mechanically coupled to an actuator operable to receive an angular displacement signal $\theta_t$ and responsive to $\theta_t$, to rotate the rotor antenna to $\theta_1$.

There is disclosed in example 16, the system of example 12, wherein the rotor antenna is configured to receive a radio frequency (RF) cable at the pivot.

There is disclosed in example 17, the system of example 12, wherein the pivot is a gravitational pivot.

There is disclosed in example 18, the system of example 17, wherein the rotor antenna has a longitudinal axis and a lateral axis, and wherein the gravitational pivot is disposed substantially on a centerline of both dimensions.

There is disclosed in example 19, the system of example 17, wherein the rotor antenna has a longitudinal axis and a lateral axis, and wherein the gravitational pivot is disposed substantially near an end point of a centerline through the lateral axis.

There is disclosed in example 20, the system of example 17, wherein the gravitational pivot comprises a radio frequency (RF) connector.

There is disclosed in example 21, the system of example 20, wherein the RF connector is rotatably mechanically coupled to an RF cable.

There is disclosed in example 22, the system of example 12, further comprising a casing, wherein the casing comprises a curved profile section disposed to reduce wireless signal interference between the first wireless transceiver and the second wireless transceiver.

There is disclosed in example 23, a method of maintaining directional communication with a wireless base station comprising:

sensing a rotation of a mobile computing device to an angle $\theta_0$; and rotating a rotary antenna to an angle $\theta_1$.

The method of example 23, wherein rotating a rotary antenna comprises passively permitting the rotary antenna to rotate under the influence of gravity.

The method of example 23, wherein:

sensing a rotation of a mobile computing device to an angle $\theta_0$ comprises actively detecting the rotation by a rotational sensor; and rotating the rotary antenna to angle $\theta_1$ comprises actively driving the rotary antenna with an actuator.

What is claimed is:

1. An apparatus comprising:

a rotor antenna operable for high-frequency directional wireless communication; and a gravitational pivot for rotatably mechanically coupling the rotor antenna to a mobile computing device;

wherein the rotor antenna is operable to rotate freely to an angle $\theta_1$ responsive to a gravitational torque of placing the rotor antenna at an angle $\theta_0$, and wherein the rotor antenna is configured to receive a radio frequency (RF) cable at the pivot.

2. The apparatus of claim 1, wherein $\theta_1$ is substantially equal to $\theta_0$.

3. The apparatus of claim 1, wherein $\theta_1$ is substantially equal to $\theta_0$ up to a limiting angle $\theta_2$.

4. The apparatus of claim 1, further comprising an angular transducer, and wherein the rotor antenna is mechanically coupled to an actuator operable to receive a transducer angular displacement signal $\theta_t$ and responsive to $\theta_t$, to rotate the rotor antenna to $\theta_1$.

5. The apparatus of claim 1, wherein the rotor antenna has a longitudinal axis and a lateral axis, and wherein the gravitational pivot is disposed substantially on a centerline of both axes.

6. The apparatus of claim 1, wherein the rotor antenna has a longitudinal axis and a lateral axis, and wherein the gravitational pivot is disposed substantially near an end point of a centerline through the lateral axis.

7. The apparatus of claim 1, wherein the gravitational pivot comprises an RF connector.

8. The apparatus of claim 7, wherein the RF connector is rotatably mechanically coupled to an RF cable.

9. The apparatus of claim 1, further comprising a casing, wherein the casing comprises a curved profile section disposed to reduce wireless signal interference between a first wireless transceiver and a second wireless transceiver.

10. A system comprising:

a first wireless transceiver; and a rotor antenna operable to communicatively couple the first wireless transceiver to a second wireless transceiver;

wherein the rotor antenna is operable to rotate freely to an angle $\theta_1$ responsive to a gravitational torque of placing the system at an angle $\theta_0$ , and wherein the rotor antenna is configured to receive a radio frequency (RF) cable at the pivot.

11. The system of claim 10, wherein $\theta_1$ is substantially equal to $\theta_0$.

12. The system of claim 10, wherein $\theta_1$ is substantially equal to $\theta_0$ up to a limiting angle $\theta_2$.

13. The system of claim 10, further comprising an angular transducer, and wherein the rotor antenna is mechanically coupled to an actuator operable to receive transducer angular displacement signal $\theta_t$ and responsive to $\theta_t$, to rotate the rotor antenna to $\theta_1$.

14. The system of claim 10, wherein the rotor antenna has a longitudinal axis and a lateral axis, and wherein the gravitational pivot is disposed substantially on a centerline of both axes.

15. The system of claim 10, wherein the rotor antenna has a longitudinal axis and a lateral axis, and wherein the gravitational pivot is disposed substantially near an end point of a centerline through the lateral axis.

16. The system of claim 10, wherein the gravitational pivot comprises an RF connector.

17. The system of claim 16, wherein the RF connector is rotatably mechanically coupled to an RF cable.

18. The system of claim 10, further comprising a casing, wherein the casing comprises a curved profile section disposed to reduce wireless signal interference between the first wireless transceiver and the second wireless transceiver.

19. A computing system, comprising:

a wireless docking station; and a computing apparatus, comprising:

a chassis;

a processor;

a memory, comprising logic to wirelessly communicatively couple to the wireless docking station;

a rotor antenna operable for directional wireless communication; and a gravitational pivot configured to receive a radio frequency (RF) cable and to rotatably mechanically couple the rotor antenna to the chassis;

wherein the rotor antenna is operable to rotate freely to an angle $\theta_1$ responsive to a gravitational torque of placing the rotor antenna at an angle $\theta_0$.

20. The computing system of claim 19, further comprising an angular transducer, and wherein the rotor antenna is mechanically coupled to an actuator operable to receive a transducer angular displacement signal $\theta_t$ and responsive to $\theta_t$, to rotate the rotor antenna to $\theta_1$.

21. The computing system of claim 19, wherein the rotor antenna has a longitudinal axis and a lateral axis, and wherein the gravitational pivot is disposed substantially on a centerline of both axes.

22. The computing system of claim 19, wherein the rotor antenna has a longitudinal axis and a lateral axis, and wherein the gravitational pivot is disposed substantially near an end point of a centerline through the lateral axis.

23. The computing system of claim 19, wherein the gravitational pivot comprises an RF connector.

24. The computing system of claim 23, wherein the RF connector is rotatably mechanically coupled to an RF cable.

25. The computing system of claim 19, further comprising a casing, wherein the casing comprises a curved profile section disposed to reduce wireless signal interference between a first wireless transceiver and a second wireless transceiver.

* * * * *